United States Patent [19]

Wolbrink

[11] 4,002,387

[45] Jan. 11, 1977

[54] CABINET ARRANGEMENT FOR TRASH COMPACTORS

[76] Inventor: David W. Wolbrink, 42 Church St., Hartford, Wis. 53027

[22] Filed: Sept. 16, 1975

[21] Appl. No.: 613,924

[52] U.S. Cl. ..... 312/350; 312/270; 100/229 A

[51] Int. Cl.[2] ..... A47B 91/00; A47B 51/00; B30B 15/06

[58] Field of Search ..... 312/350, 270; 108/13, 108/28, 62, 90; 16/170, 171, 172

[56] References Cited

UNITED STATES PATENTS

| | | | |
|---|---|---|---|
| 9,448 | 12/1852 | Grant | 16/171 |
| 1,646,631 | 12/1912 | Nelson et al. | 108/62 |
| 1,697,178 | 1/1929 | Fyfe | 16/172 |
| 2,833,609 | 5/1958 | Lawless | 108/62 |
| 2,903,312 | 9/1959 | Lawless | 108/13 |
| 3,214,228 | 10/1965 | Lewis | 312/350 |
| 3,362,767 | 1/1968 | Chancellor, Jr. | 108/90 |
| 3,378,323 | 4/1968 | Goldberg | 312/270 |
| 3,528,718 | 9/1970 | Johnson et al. | 312/270 |
| 3,556,619 | 1/1971 | Bottas et al. | 312/211 |
| 3,710,419 | 1/1973 | DeGroft | 16/171 |

*Primary Examiner*—Paul R. Gilliam
*Assistant Examiner*—V. Sakran
*Attorney, Agent, or Firm*—Andrus, Sceales, Starke & Sawall

[57] ABSTRACT

A cabinet for a household trash compactor incorporates a cutting board on the top to enclose a bag storage compartment. The cutting board is reversible and is both hinged to permit access to the bag storage compactment and removable for cleaning and detached use.

4 Claims, 3 Drawing Figures

CABINET ARRANGEMENT FOR TRASH COMPACTORS

BACKGROUND OF THE INVENTION

1. Field of the Invention

The present invention relates to trash compactors of the home appliance type and more particularly to a cutting board arrangement for the top of such compactors.

2. Summary of the Present Invention

Household trash compactors typically include a cabinet having a motor driven platen or ram which is driven into a trash containing receptacle to effect the compaction. The cabinet includes an access means by which trash to be compacted may be deposited in a bag lining the receptacle and the full bag removed to dispose of the compacted trash. Extra bags and other supplies may be stored in a compartment on top of the compactor, usually accessible through an additional door in the front of the compactor.

In trash compactors of the free standing type it is often desired to employ the top of the cabinet in some useful manner. The height of the trash compactor typically positions the top of the compactor at a convenient level for a work surface and a cutting board is affixed to the top of the cabinet.

The present invention is directed to an improved cutting board arrangement for trash compactors which provides both convenient access to the bag storage compartment in the top of the cabinet and a reversible cutting board which may be used on the compactor and separate therefrom.

In the present invention, the cutting board is positioned on top of the trash compactor to complete the enclosure of the bag storage compartment. The cutting board is hinged on one end, preferably the rear end, of the top of the compactor by hinges located at the sides of the compactor. The hinges include a pair of brackets embracing the cutting board and having upwardly facing notches for receiving hinge pins on the sides of the board. The notches are preferably triangularly shaped to permit removal of the cutting board and the hinge pins preferably located in the center of the thickness of the cutting board so as to permit the cutting board to be placed with either side as the exposed surface.

DESCRIPTION OF THE PREFERRED EMBODIMENT

Figure 1:
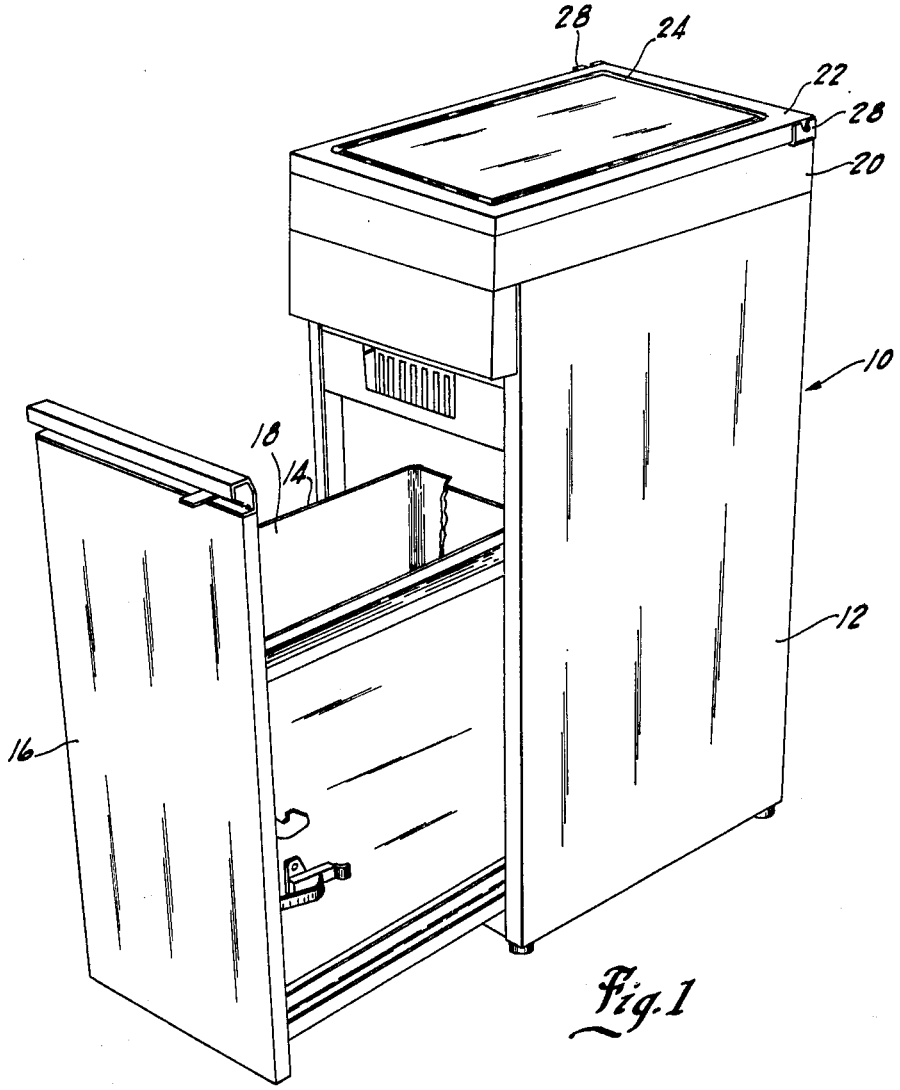
FIG. 1 is a perspective view of a trash compactor showing the improved cutting board arrangement of the present invention.

Turning now to the Figures, there is shown in FIG. 1 a trash compactor identified by the numeral 10. Trash compactor 10 typically includes cabinet 12 containing a compacting mechanism, not shown, in the upper portions thereof. Receptacle 14 for receiving the trash to be compacted is positioned in the lower portion of cabinet 12 beneath the compaction mechanism. An access means is provided to the interior of cabinet 12 through which the trash may be deposited in receptacle 14 and the receptacle removed from cabinet 12 to dispose of the compressed trash. In the compactor shown in the Figures, drawer 16 is provided in the front of compactor 10 for this purpose.

Receptacle 14 is commonly lined with a bag 18 in which the trash to be compacted is placed and the compacted trash removed. A compartment 20 for storing bags 18 prior to use may be provided in the upper portions of cabinet 12.

In the present invention, compartment 20 is closed on the top by cutting board 22. Cutting board 22 may be formed of a solid or laminated piece of wood appropriately sized for the dimensions of cabinet 12. Both sides of cutting board 22 are designed to provide a work surface. The work surfaces of cutting board 22 may contain grooves or well 24 for retaining liquids produced during cutting.

Figure 3:
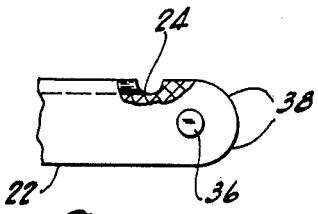
FIG. 3 is a partial, broken away, perspective view of the end of the cutting board employed in the hinge arrangement.
Figure 2:
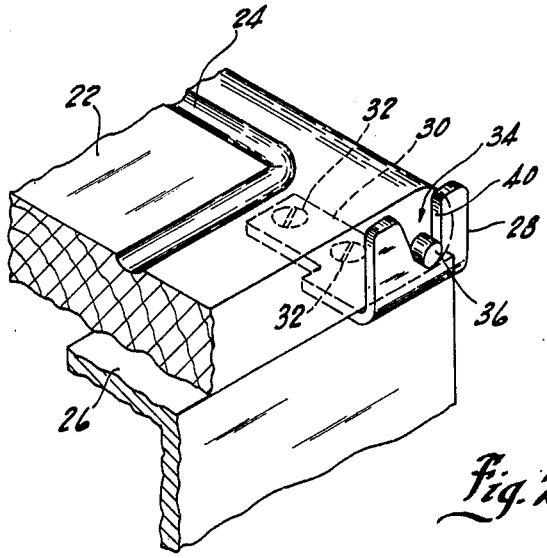
FIG. 2 is a partial, enlarged, perspective view of the cuttingg board arrangement showing in detail the hinge arrangement for the cutting board.

Cutting board 22 rests on flanges 26 of compartment 20, as shown in detail in FIG. 2, and is hinged so that the board may be raised to gain access to bag storage compartment 20. For this purpose, a pair of brackets 28 are mounted on the rear corners of cabinet 12, as shown in FIGS. 1 and 2. Each bracket 28 includes a projection 30 which is bolted to flange 26 by bolts 32. Brackets 28 contain upwardly facing notches 34 for receiving hinge pins 36 which are driven into and extend from either side of cutting board 22. Notches 34 are in the shape of inverted triangles with hinge pins 36 resting in the apexes of the triangles. To facilitate the hinging action and the raising of cutting board 22, one or both of rear edges 38 of cutting board 22 may be rounded, as shown in FIG. 3. Preferably, the rear edge 40 of the triangular notch is generally vertical so that the pins are retained in the notches against the rearward and upward forces exerted on the cutting board when it is swung open The triangular shape of notches 34 permits the removal of cutting board 22 by lifting hinge pins 36 out of the notches and the cutting board off flanges 26. This facilitates cleaning of the cutting board and permits use of the board as a carving platter at the dining table. Cutting board 22 is replaced on compactor 10 by dropping hinge pins 36 in notches 38. Hinge pins 36 may be positioned in the center of the thickness of cutting board 22, as shown in FIG. 3, so that the board will rest on flanges 26 regardless of which side is used as the work surface. The cutting board is thus reversible and either side may be used as a cutting surface.

Various modes of carrying out the invention are contemplated as being within the scope of the following claims particularly pointing out and distinctly claiming the subject matter which is regarded as the invention.

I claim:

1. In a free standing trash compactor having a cabinet for containing a compacting mechanism and a receptacle in which compaction occurs, said cabinet having sidewalls and an upper end, the improvement comprising:

a reversible cutting board positionable on said cabinet upper end, said cutting board being hinged at one of its ends on said cabinet for upward pivotal movement by a hinge arrangment comprising a pair of brackets mounted adjacent the sidewalls of the cabinet, one of said brackets being contiguous with each of the sides of said cutting board adjacent said end for embracing said end of said cutting board, said brackets having upwardly facing notches formed for freely receiving pins extending from the center of the thickness of said cutting board at said embraced end by a downward movement of said board and restraining said pins at a pivot point during upward pivotal movement of said cutting board.

2. The improvement of claim 1 wherein said brackets are further defined as having triangularly shaped, upwardly diverging notches with an apex in the lower portion of said bracket for restraining said pins.

3. The improvement according to claim 1 wherein the cabinet has a bag storage means in the upper end thereof having an open upper end and wherein said reversible cutting board completes the enclosure of the bag storage compartment.

4. The improvement according to claim 2 wherein one side of said notches is generally vertical.

* * * * *